US009128506B2

(12) United States Patent
Kung et al.

(10) Patent No.: US 9,128,506 B2
(45) Date of Patent: Sep. 8, 2015

(54) POWER TRACKING DEVICE AND POWER TRACKING METHOD

(75) Inventors: Kuo-Sen Kung, Hsin-Chu (TW); Chun-Hao Tu, Hsin-Chu (TW); Ren-Hong Jhan, Hsin-Chu (TW); Wei-Cheng Wu, Hsin-Chu (TW); Ya-Zhi Hsiao, Hsin-Chu (TW); Ting-Chun Lin, Hsin-Chu (TW); Jen-Pei Tseng, Hsin-Chu (TW); Yu-Jung Liu, Hsin-Chu (TW); Jiun-Jye Chang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 434 days.

(21) Appl. No.: 13/600,531

(22) Filed: Aug. 31, 2012

(65) Prior Publication Data

US 2013/0285636 A1 Oct. 31, 2013

(30) Foreign Application Priority Data

Apr. 28, 2012 (CN) ..... 2012 1 0135206

(51) Int. Cl.
*G05F 5/00* (2006.01)
*G05F 1/67* (2006.01)

(52) U.S. Cl.
CPC ..... *G05F 1/67* (2013.01)

(58) Field of Classification Search
CPC ..... G05F 1/67
USPC ..... 323/299
See application file for complete search history.

(56) References Cited

U.S. PATENT DOCUMENTS

| | | | | |
|---|---|---|---|---|
| 4,375,662 | A * | 3/1983 | Baker | 323/299 |
| 4,404,472 | A * | 9/1983 | Steigerwald | 323/906 |
| 4,580,090 | A * | 4/1986 | Bailey et al. | 323/303 |
| 5,001,415 | A * | 3/1991 | Watkinson | 323/304 |
| 5,654,883 | A * | 8/1997 | Takehara et al. | 323/906 |
| 5,892,354 | A * | 4/1999 | Nagao et al. | 323/299 |
| 8,354,820 | B2 | 1/2013 | Liu | |
| 8,390,242 | B2 | 3/2013 | Liu | |
| 2006/0055366 | A1 | 3/2006 | Tsunetsugu et al. | |
| 2008/0149167 | A1 | 6/2008 | Liu | |

FOREIGN PATENT DOCUMENTS

| | | |
|---|---|---|
| CN | 87101231 | 7/1988 |
| CN | 2711866 | 7/2005 |

(Continued)

OTHER PUBLICATIONS

Park et al., Hysteresis controller based MPPT energy harvesting system for microbial fuel cells, Jan. 2012, JPS, JPS205,151-156.*

*Primary Examiner* — Jue Zhang
(74) *Attorney, Agent, or Firm* — WPAT, P.C.; Justin King

(57) ABSTRACT

A power tracking device and a power tracking method is disclosed herein. The power tracking device includes a power voltage setting circuit, a switch, a switching signal circuit, and a voltage memory circuit. The switching signal circuit is configured for sending a first control signal to the switch. When the switch receives the first control signal and electrically isolates the power source and the power voltage setting circuit, the voltage memory circuit stores an open circuit voltage of the power source and sends a setting voltage relative to the open circuit voltage, and when the switch receives the first control signal and electrically connects the power source and the power voltage setting circuit, the power voltage setting circuit sets an output voltage of the power source to correspond with the setting voltage.

20 Claims, 7 Drawing Sheets

(56) References Cited

FOREIGN PATENT DOCUMENTS

| | | | | |
|---|---|---|---|---|
| CN | 101246377 | 8/2008 | | |
| CN | 101418991 A | * | 4/2009 | |
| CN | 101474072 | | 7/2009 | |
| JP | 2000003224 | | 1/2000 | |
| TW | 200827970 | | 7/2008 | |

* cited by examiner

Replacement sheet

Replacement sheet

POWER TRACKING DEVICE AND POWER TRACKING METHOD

RELATED APPLICATIONS

This application claims priority to China Application Serial Number 201210135206.6, filed Apr. 28, 2012, which is herein incorporated by reference.

BACKGROUND

1. Field of Invention

The present invention relates to electronic technology. More particularly, the present invention relates to power tracking technology.

2. Description of Related Art

In recent years, due to the increased awareness of environmental protection issues, green energy technology has been developed. Attempts are being made to combine many architectural structures and electronic products with green energy technology. An example of this is the solar notebook.

The difference between a solar panel on an architectural structure and a solar battery in a portable electronic product is related to the fact that the operating environment of a portable electronic product may change rapidly. That is, since the luminance of the light received by the solar battery of a portable electronic product is constantly changing, the solar battery in a portable electronic product must be capable of dealing with such a variance in luminance.

A solar power source is an unsteady power source, due to the changing luminance of the operating environment. The maximum power point of a solar panel is an unsteady value which varies corresponding to the luminance of the environment. Therefore, obtaining the maximum output power of a solar battery is a big challenge.

The two most common ways to track maximum power for a solar battery are to determine a point as the maximum power point and to dynamically track the real maximum power point. The method of determining a point as the maximum power point is rather simple, but results in acquiring the maximum power for only one certain environmental situation, and an ability to vary an output corresponding to changes in the environment is not possible with such a method. On the other hand, while the method of dynamically tracking the real maximum power point results in a better performance, since microcontrollers are necessary for logic determinations during dynamic tracking, much power is consumed and a longer operating time is involved, thereby limiting the application of this method.

Therefore, the defects and inconveniences associated with the maximum power point tracking methods mentioned above must be overcome, and while those in the field are working hard in this regard, a suitable way has still not been found. Hence, a solution to deal with a changing environment for a power source (e.g., a solar battery) when used for 3C (computer, communication, and consumer-electronics) products is not only an important area of research, but has also become a subject that those in relevant fields are endeavoring to improve upon.

SUMMARY

Therefore, an aspect of the invention is to provide a power tracking device to deal with the problem of a changing environment when a power source is applied to a 3C product.

According to an embodiment of the invention, the power tracking device includes a power voltage setting circuit, a switch, a switching signal circuit, and a voltage memory circuit. A first terminal of the switch is connected to a power source, and a second terminal of the switch is connected to the power voltage setting circuit. The switching signal circuit is configured for sending a first control signal to the switch. When the switch receives the first control signal and electrically isolates the power source and the power voltage setting circuit, the voltage memory circuit stores an open circuit voltage of the power source and sends a setting voltage relative to the open circuit voltage, and when the switch receives the first control signal and electrically connects the power source and the power voltage setting circuit, the power voltage setting circuit sets an output voltage of the power source to correspond with the setting voltage.

Another aspect of the invention is to provide a power tracking method. According to an embodiment of the invention, the power tracking method includes a number of steps. A first control signal is sent to a switch, in which a first terminal of the switch is connected to a power source and a second terminal of the switch is connected to a power voltage setting circuit. When the switch receives the first control signal and electrically isolates the power source and the power voltage setting circuit, an open circuit voltage of the power source is stored and a setting voltage relative to the open circuit voltage is sent. The first control signal is sent to the switch. When the switch receives the first control signal and electrically connects the power source and the power voltage setting circuit, the power voltage setting circuit sets an output voltage of the power source to correspond with the setting voltage.

Still another aspect of the invention is to provide a power tracking device. According to an embodiment of the invention, the power tracking device includes a power voltage setting circuit, a switch, and a voltage memory circuit. A first terminal of the switch is connected to a power source, a second terminal of the switch is connected to the power voltage setting circuit, and the switch is opened or closed relative to a first control signal. The voltage memory circuit is configured for storing an open circuit voltage of the power source and sending a setting voltage relative to the open circuit voltage.

The following paragraphs will provide specific details of the aforementioned description with some embodiments to interpret the techniques of the present invention.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
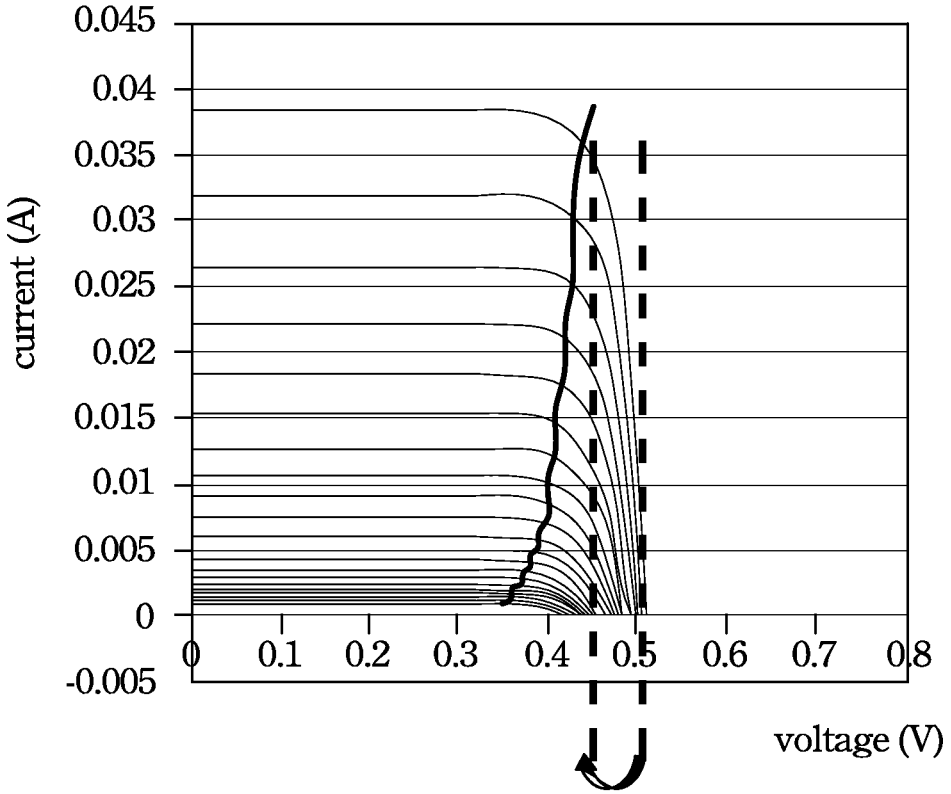
FIG. 1 is an I-V (current-voltage) graph of a solar battery according to an experimental example of the invention.

In the following detailed description, for purposes of explanation, numerous specific details are set forth in order to attain a thorough understanding of the disclosed embodiments. It will be apparent, however, that one or more embodiments may be practiced without these specific details. In other instances, well-known structures and devices are schematically shown in order to simplify the drawing.

As used in the description herein and throughout the claims that follow, the meaning of "a," "an," and "the" includes reference to the plural unless the context clearly dictates otherwise. Also, as used in the description herein and throughout the claims that follow, the terms "comprise" or comprising," "include" or "including," "have" or "having," "contain" or "containing" and the like are to be understood to be open-ended, i.e., to mean including but not limited to. Also, as used in the description herein, the range of error to the values modified by the term "substantially" is generally 20%, and it can be 10% in some preferred cases, and moreover, it can also be 5% in some most preferred cases. In addition, when an element is referred to as being "connected" or "coupled" to another element, it can be directly connected or coupled to the other element or intervening elements may be present.

FIG. 1 is an I-V graph of a solar battery according to an experimental example of the invention. As shown in FIG. 1, a maximum power point voltage (Vmp) is K times of an open circuit voltage (Voc), that is, Vmp=K*Voc, and such a difference is related to the type of the solar battery, resistors connected in parallel, and resistors connected in series. The open circuit voltage (Voc) is the voltage when the current of the solar battery is zero, and a short circuit current is the current when the voltage of the solar battery is zero.

Figure 2:
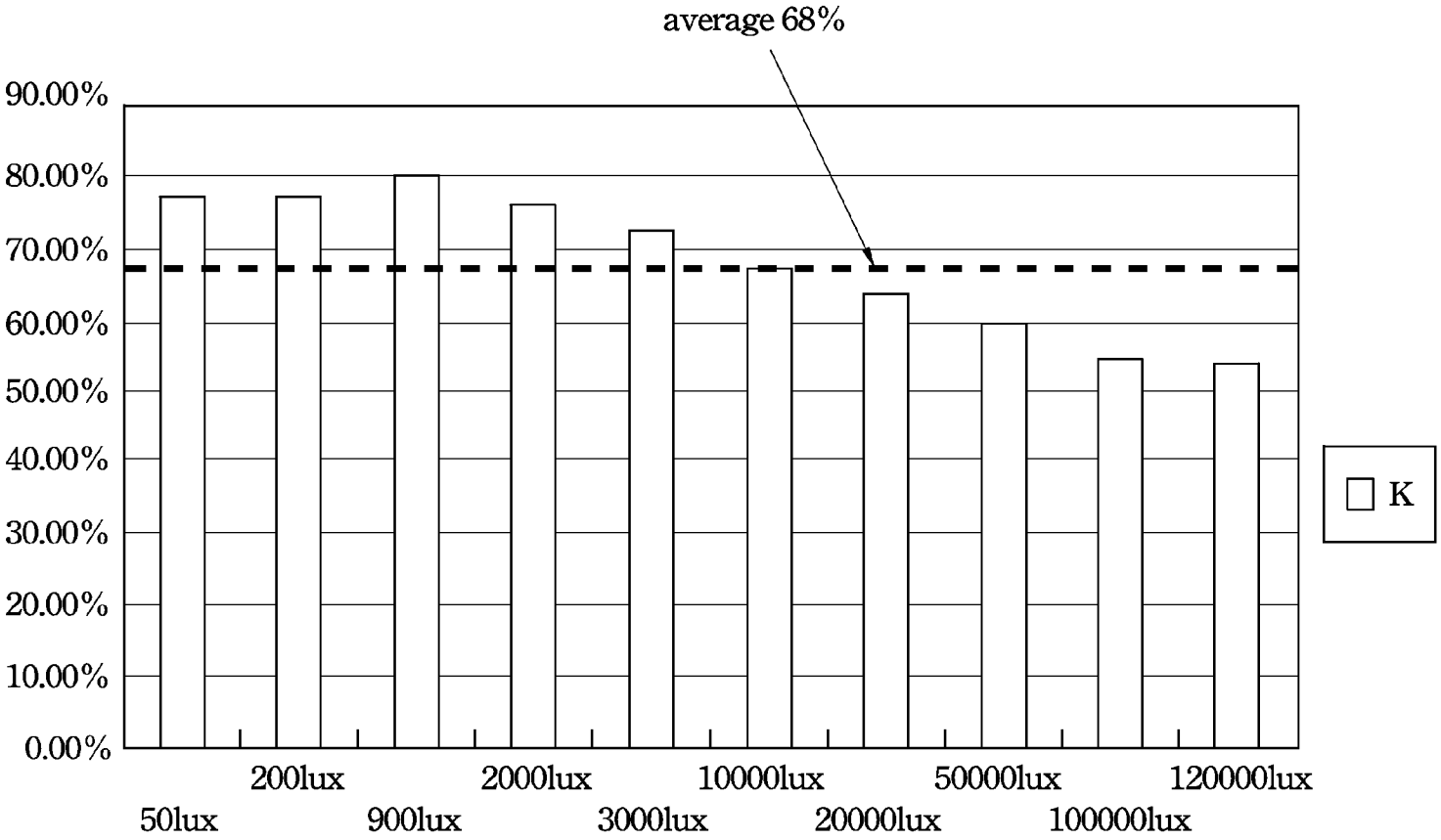
FIG. 2 is a graph illustrating different values K when a solar battery according to an experimental example of the invention is exposed to different luminances.

The value K is altered when the solar battery is exposed to different luminances, and the variation of the value K is related to the material and the structure of the solar battery. FIG. 2 is a graph illustrating different values K when a solar battery according to an experimental example of the invention is exposed to different luminances. As shown in FIG. 2, in this kind of solar battery, the value K is high when the solar battery is exposed to a low luminance, and on the other hand, the value K is relatively low when the solar battery is exposed to a high luminance. As noted above, different solar batteries correspond to different values K.

When the electrical characteristics of the solar battery are known, the value K can be determined to be a certain value (for example, an average value 68%) so as to make the solar battery work in a condition that the output voltage is 68% of the open circuit voltage (Voc). That is, although the luminance is different, the solar battery uses 68% as the working condition.

Figure 3:
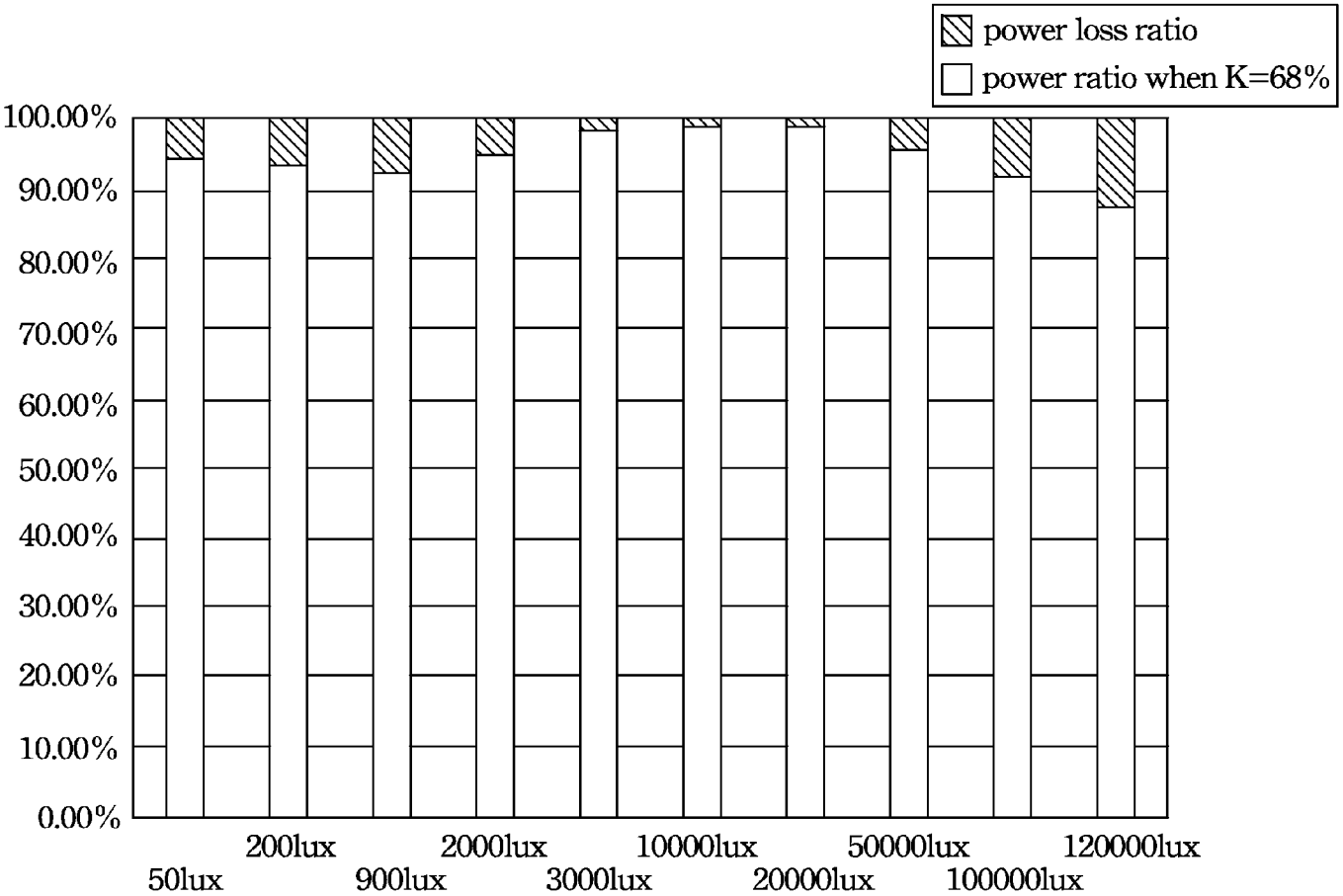
FIG. 3 is a graph illustrating power losses of the solar battery according to an experimental example of the invention when the solar battery is exposed to different luminances.

As shown in FIG. 2, the value K of the solar battery varies when the solar battery is exposed to different luminances. Hence, if one certain point is fixed as a working point, it is expected that the output power will be far from the maximum power. However, with reference to FIG. 3, it is obvious that the actual outcome is better than what is expected. In FIG. 3, the white portions indicate the output power ratios when K=68%, and the portions with diagonal lines indicate the power loss ratios when K=68%. As shown in FIG. 3, when K=68%, more than 80% power can be outputted, and this information may be useful in a real-life situations.

The value K does not necessarily have to be fixed at 68%, and in practice, a better value K can be selected utilizing known electrical characteristics, as shown in the next experimental example. In this next experimental example, K=60% is selected as a working point. That is, in different light environments, all of the output voltages (Vout) of the solar battery are fixed to 60% of the open circuit voltages (Voc). The output power of the solar battery under such a condition is shown in FIG. 4.

Figure 4:
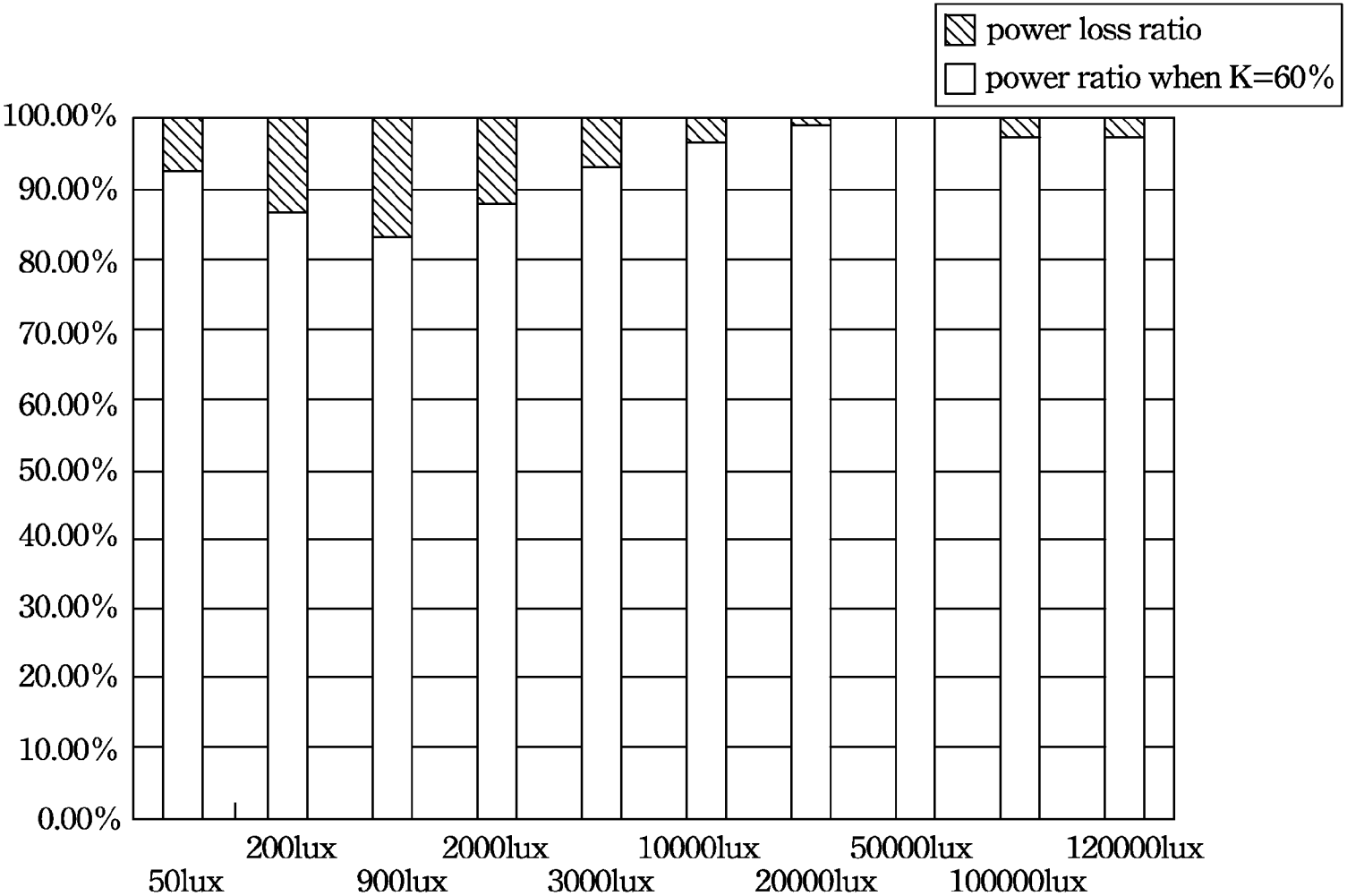
FIG. 4 is a graph illustrating power losses of the solar battery according to another experimental example of the invention when the solar battery is exposed to different luminances.

As shown in FIG. 4, the overall output power is more than 80% of the maximum power. In some conditions, the efficiency is worse than when K=68%, but when seen from the point of view of power loss, the power loss can be decreased from 45 mW to 8 mW, such that the energy loss in a high luminance environment can be brought down effectively. Therefore, when the electrical characteristics are known, it would be more efficient to acquire the solar power associated with a suitable working point.

In this regard, an aspect of the invention is a power tracking device, which can be applied to a solar power device or to various kinds of power sources. It should be noted that the power tracking device of this aspect does not require complex logical operations for acquiring a working point that is close to the maximum power. The following paragraphs will provide specific details of the overall structure of the power tracking device with reference to FIG. 5 and FIG. 6.

Figure 5:
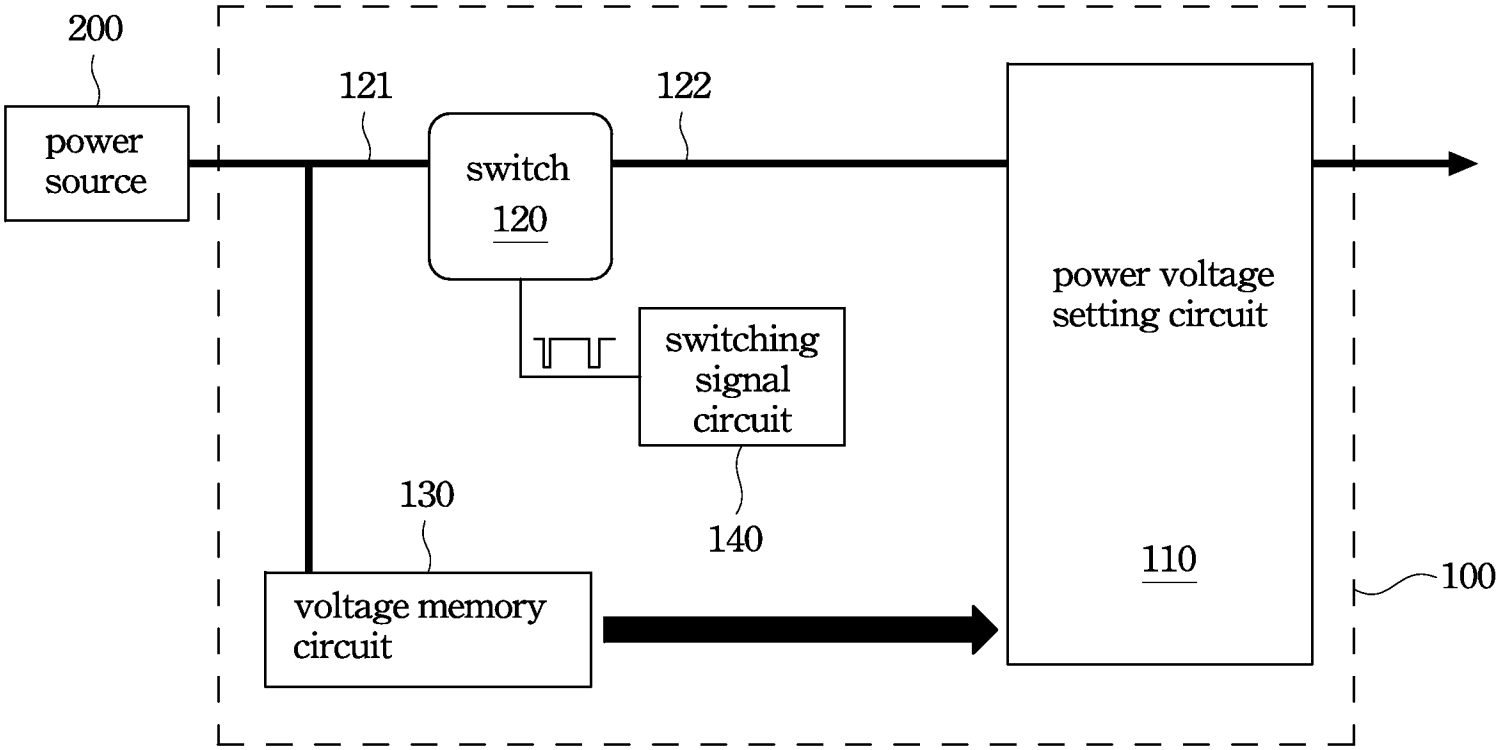
FIG. 5 is a block diagram of a power tracking device according to an embodiment of the invention.

FIG. 5 is a block diagram of a power tracking device according to an embodiment of the invention. The power tracking device 100 includes a power voltage setting circuit 110, a switch 120, and a voltage memory circuit 130. A first terminal 121 of the switch 120 is connected to a power source 200, and a second terminal 122 of the switch 120 is connected to the power voltage setting circuit 110.

The switch 120 is configured to open or close relative to a first control signal. The voltage memory circuit 130 is configured to store an open circuit voltage (Voc) of the power source 200 and send a setting voltage (Vset) corresponding to the open circuit voltage (Voc) to the power voltage setting circuit 110 (that is, Voc*K=Vset), so that the power voltage setting circuit 110 can set an output voltage (Vout) of the power source 200 to correspond with the setting voltage (Vset). Through such a configuration, a better working point can be tracked in a varying environment.

For sending the first control signal to open or close the switch 120, the power tracking device includes a switching signal circuit 140. The switching signal circuit 140 is electrically coupled to the switch 120. In operation, firstly, the switching signal circuit 140 sends the first control signal to the switch 120, and when the switch 120 receives the first control signal and electrically isolates the power source 200 and the power voltage setting circuit 110, the voltage memory circuit 130 stores the open circuit voltage (Voc) of the power source 200 and sends the setting voltage (Vset) relative to the open circuit voltage (Voc). Subsequently, the switching signal circuit 140 sends the first control signal to the switch 120 again, and when the switch 120 receives the first control signal again and electrically connects the power source 200 and the power voltage setting circuit 110, the power voltage setting circuit 110 sets the output voltage (Vout) of the power source 200 to correspond with the setting voltage (Vset).

Figure 6:
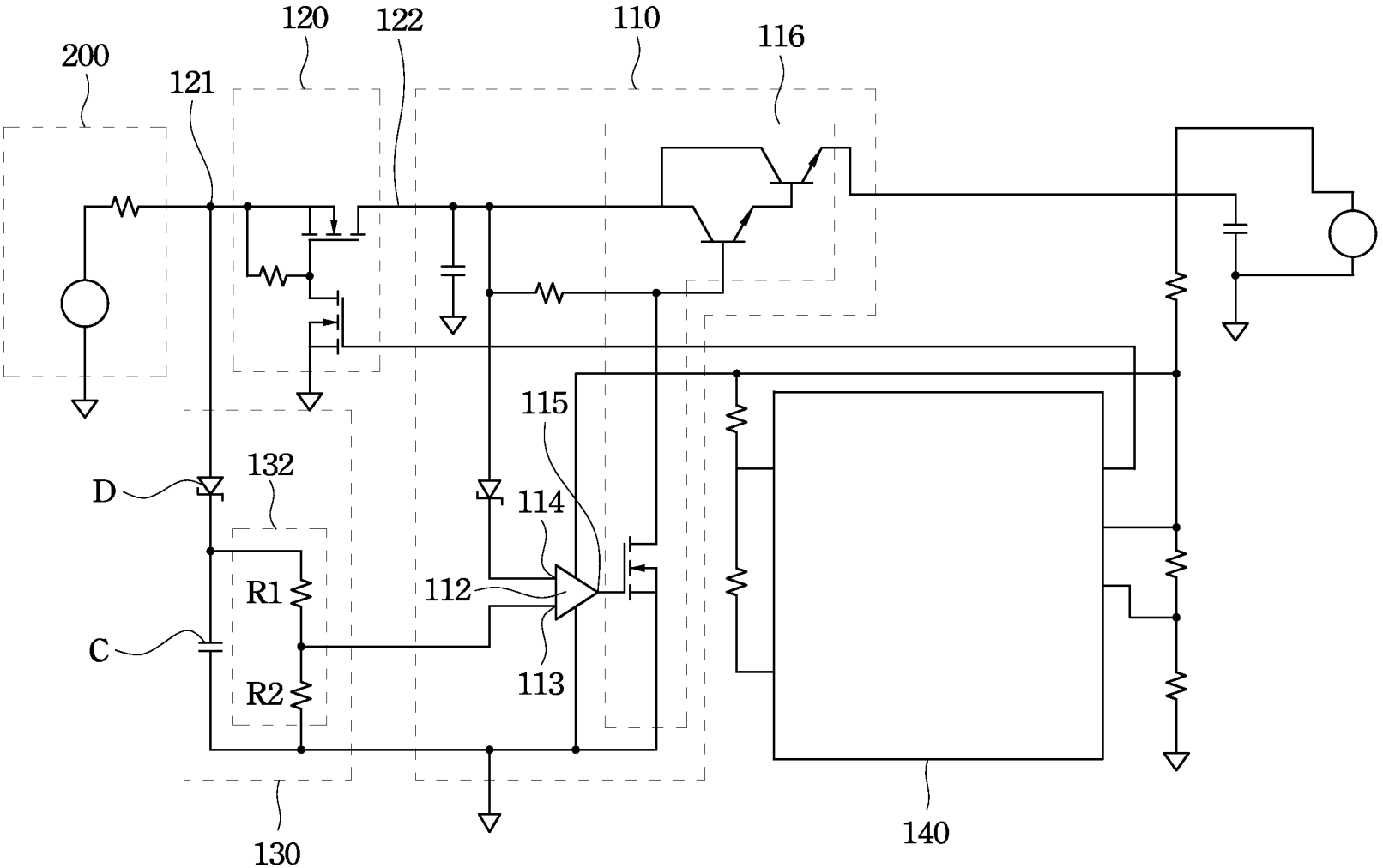
FIG. 6 is an electrical circuit diagram of the power tracking device in FIG. 5.

In order to provide more details of the power tracking device 100, reference will now be made to FIG. 6 which is an electrical circuit diagram of the power tracking device 100 in FIG. 5. The voltage memory circuit 130 includes a capacitor C, an anti-backflow device D, and a voltage dividing circuit 132. It should be noted that, although the anti-backflow device D in FIG. 6 is drawn as a Zener diode, the invention is not limited in this regard, and in practice, the anti-backflow device D may be a common diode, a BJT, a MOS, other suitable anti-backflow mechanisms, or a combinational circuit thereof. One skilled in the art should choose a suitable configuration on the basis of actual requirements.

The anti-backflow device D is connected to the power source 200, the capacitor C, and the voltage dividing circuit 132, and the voltage dividing circuit 132 is connected to the capacitor C. In operation, the anti-backflow device D can keep the open circuit voltage (Voc) inside the capacitor C, such that the capacitor C can store the open circuit voltage (Voc) of the power source 200. The voltage dividing circuit 132 is configured to divide the open circuit voltage (Voc) into the setting voltage (Vset) mentioned above. In such a manner, the setting voltage (Vset) can be outputted according to a divided voltage on the basis of the value K.

The voltage dividing circuit 132 includes a first resistor R1 and a second resistor R2. A terminal of the first resistor R1 is connected to a terminal of the capacitor C, and another terminal of the capacitor C is connected to ground. A terminal of the second resistor R2 is connected in series to another terminal of the first resistor R1, and another terminal of the second resistor R2 is connected to ground. Through such a configuration, the resistances of the first and second resistors R1, R2 can be adjusted, such that the resistance of R2 divided by the sum of the resistance of R1 and the resistance of R2 is equal to the value K (e.g. R2/(R1+R2)=K).

In practice, the power source may be a solar panel, and one of the first and the second resistor R1, R2 is a photoresistor. In such a configuration, the photoresistor can exhibit different resistances when exposed to different luminances, so as to alter the voltage dividing ratio relative to the variance of luminance.

Figure 7:
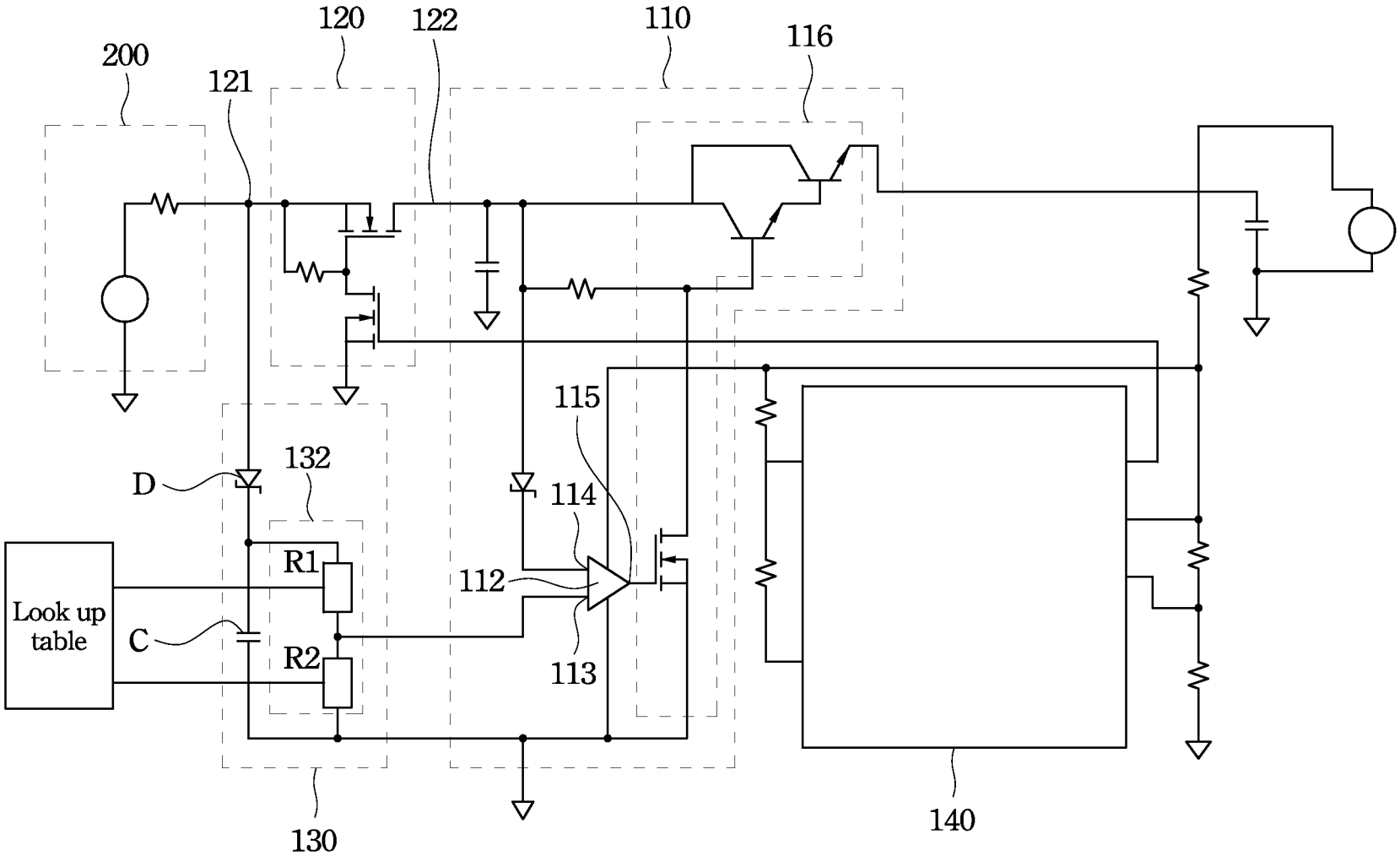
FIG. 7 is an electrical circuit diagram of the power tracking device in FIG. 5 in according to another embodiment.

In some embodiments, one of the first and the second resistor R1, R2 may be a digital resistor, and the digital resistor may adjust its resistance based on a maximum power point voltage (Vmp) corresponding to the open circuit voltage (Voc) in a lookup table (as shown in FIG. 7). For example, the lookup table may record each maximum power point voltage (Vmp) corresponding to the open circuit voltage (Voc) in different luminances, such as the relationships shown in FIG. 1, and the digital resistor can find out the maximum power point voltage (Vmp) corresponding to the current open circuit voltage (Voc) from the lookup table, so as to alter a voltage dividing ratio of the voltage dividing circuit 132 corresponding to a change of the open circuit voltage (Voc) caused by a change of the light.

In one embodiment, the voltage dividing ratio of the voltage dividing circuit 132 is determined by an average ratio between each open circuit voltage (Voc) and a corresponding maximum power point voltage (Vmp) when the power source is in different operating environments. For example, if the power source 200 is a solar panel, the voltage dividing ratio of the voltage dividing circuit 132 is determined by an average ratio between each open circuit voltage (Voc) and a corresponding maximum power point voltage (Vmp) (e.g., maximum power point voltages corresponding to the open circuit voltages (Voc)) when the solar panel is exposed to different luminances. In other words, the voltage dividing ratio is an average value of different values K in different luminances.

As shown in FIG. 6, the power voltage setting circuit 110 includes a comparator 112 and an output circuit 116. The comparator 112 includes a first input port 113, a second input port 114, and an output port 115. The first input port 113 is electrically coupled to the voltage dividing circuit 132, the second input port 114 is connected to the second terminal 122 of the switch 120, and the output port 115 is connected to the output circuit 116.

The first input port 113 is configured to receive the setting voltage (Vset) mentioned above, and the output circuit 116 is configured to output the output voltage (Vout) of the power source 200. When the voltage of the first input port 113 is higher than the voltage of the second input port 114, the comparator 112 outputs a second control signal to electrically isolate the power source 200 and the power voltage setting circuit 110. When the voltage of the first input port 113 is lower than the voltage of the second input port 114, the comparator 112 outputs the second control signal to electrically connect the power source 200 and the power voltage setting circuit 110. Through such a switching mechanism, the output voltage (Vout) of the power source 200 and the setting voltage (Vset) can be substantially the same.

Another aspect of the invention is a power tracking method. The power tracking method includes a number of steps. (a) A first control signal is sent to the switch 120, in which the first terminal 121 of the switch 120 is connected to the power source 200 and the second terminal 122 of the switch 120 is connected to the power voltage setting circuit 110. (b) When the switch 120 receives the first control signal and electrically isolates the power source 200 and the power voltage setting circuit 110, an open circuit voltage (Voc) of the power source 200 is stored and a setting voltage (Vset) relative to the open circuit voltage (Voc) is sent. (c) The first control signal is sent to the switch 120. (d) When the switch 120 receives the first control signal and electrically connects the power source 200 and the power voltage setting circuit 110, the power voltage setting circuit 110 sets an output voltage (Voc) of the power source 200 to correspond with the setting voltage (Vset).

Step (b) includes a step of electrically dividing the open circuit voltage (Voc) into the setting voltage (Vset).

If the power source 200 is a solar panel, the power tracking method may further include a step of adjusting a voltage dividing ratio (e.g., the ratio between the open circuit voltage (Voc) and the setting voltage (Vset)) relative to the current luminance of the solar panel, so as to accomplish a control corresponding to a change of the light.

The power tracking method mentioned above may further include a step of setting the voltage dividing ratio according to a relationship between the open circuit voltage (Voc) and a corresponding maximum power point voltage (Vmp) in a look up table, so as to accomplish a control corresponding to a change of the open circuit voltage (Voc) caused by a change of the light.

If the power source 200 is a solar panel, the voltage dividing ratio may be determined by an average ratio between each open circuit voltage (Voc) and a corresponding maximum power point voltage (Vmp) when the solar panel is in different luminance environments. That is, the voltage dividing ratio may be determined by an average value of different values K in different luminances.

The power tracking method may further include a step in which when the voltage of the first input port 113 of the capacitor 112 is higher than the voltage of the second input port 114 of the capacitor 112, a second control signal is generated to electrically isolate the power source 200 and the power voltage setting circuit 110, and when the voltage of the first input port 113 of the capacitor 112 is lower than the voltage of the second input port 114 of the capacitor 112, the second control signal is generated to electrically connect the power source 200 and the power voltage setting circuit 110.

Through such a switching mechanism, the output voltage (Vout) of the power source 200 and the setting voltage (Vset) are substantially the same.

Therefore, compared with the conventional art, the invention has at least the following advantages:

1. The control performed corresponds to variances in the environment.

2. A work point approaching maximum power can be obtained without having to perform complex logical operations.

Although the present invention has been described in considerable detail with reference to certain embodiments thereof, other embodiments are possible. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A power tracking device, comprising:

a power voltage setting circuit comprising an output circuit, wherein the output circuit is configured for outputting an output voltage of a power source, and the output circuit comprises an output switch;

a switch, wherein a first terminal of the switch is connected to a power source, a second terminal of the switch is connected to the output switch of the power voltage setting circuit, and the switch is configured to switch on to conduct the power source to the output switch;

a switching signal circuit for sending a first control signal to the switch; and a voltage memory circuit, wherein when the switch receives the first control signal and electrically isolates the power source and the power voltage setting circuit, the voltage memory circuit stores an open circuit voltage of the power source and sends a setting voltage relative to the open circuit voltage, and when the switch receives the first control signal and electrically connects the power source and the power voltage setting circuit, the power voltage setting circuit sets the output voltage of the power source to correspond with the setting voltage.

2. The power tracking device of claim 1, wherein the voltage memory circuit comprises:

a capacitor;

an anti-backflow device for keeping the open circuit voltage inside the capacitor; and a voltage dividing circuit connected to the capacitor, the voltage dividing circuit dividing the open circuit voltage into the setting voltage.

3. The power tracking device of claim 2, wherein the voltage dividing circuit comprises:

a first resistor, wherein a terminal of the first resistor is connected to a terminal of the capacitor, and another terminal of the capacitor is connected to a ground; and a second resistor, wherein a terminal of the second resistor is connected in series to another terminal of the first resistor, and another terminal of the second resistor is connected to ground.

4. The power tracking device of claim 3, wherein the power source is a solar panel, and one of the first and the second resistor is a photoresistor.

5. The power tracking device of claim 3, wherein one of the first and the second resistor is a digital resistor, and the digital resistor adjusts its resistance based on a maximum power point voltage corresponding to the open circuit voltage in a lookup table.

6. The power tracking device of claim 2, wherein a voltage dividing ratio of the voltage dividing circuit is determined by an average ratio between each open circuit voltage and a corresponding maximum power point voltage when the power source is in different operating environments.

7. The power tracking device of claim 1, wherein the power voltage setting circuit further comprises:

a comparator comprising a first input port, a second input port, and an output port, wherein the first input port receives the setting voltage, and the second input port is connected to the second terminal of the switch; and wherein when the voltage of the first input port is higher than the voltage of the second input port, the comparator outputs a second control signal to electrically isolate the power source and the power voltage setting circuit, and when the voltage of the first input port is lower than the voltage of the second input port, the comparator outputs the second control signal to electrically connect the power source and the power voltage setting circuit.

8. A power tracking method, comprising:

sending a first control signal to a switch, wherein a first terminal of the switch is connected to a power source, a second terminal of the switch is connected to an output switch of an output circuit of a power voltage setting circuit, and the switch is configured to switch on to conduct the power source to the output switch;

when the switch receives the first control signal and electrically isolates the power source and the power voltage setting circuit, storing an open circuit voltage of the power source and sending a setting voltage relative to the open circuit voltage;

sending the first control signal to the switch; and when the switch receives the first control signal and electrically connects the power source and the power voltage setting circuit, the power voltage setting circuit setting an output voltage of the power source to correspond with the setting voltage.

9. The power tracking method of claim 8, wherein the step of storing the open circuit voltage of the power source and sending a setting voltage relative to the open circuit voltage comprises:

electrically dividing the open circuit voltage into the setting voltage.

10. The power tracking method of claim 9, wherein the power source is a solar panel, and the power tracking method further comprises:

adjusting a voltage dividing ratio relative to a current luminance of the solar panel.

11. The power tracking method of claim 9, further comprises:

setting a voltage dividing ratio according to a relationship between the open circuit voltage and a corresponding maximum power point voltage in a look up table.

12. The power tracking method of claim 9, wherein the power source is a solar panel, a voltage dividing ratio is determined by an average ratio between each open circuit voltage and a corresponding maximum power point voltage when the solar panel is in different luminance environments.

13. The power tracking method of claim 8, wherein the power voltage setting circuit comprises a comparator and the output circuit, a first input port of the comparator receives the setting voltage, a second input port of the comparator is connected to the second terminal of the switch, and the output circuit is connected to an output port of the comparator, the power tracking method further comprising:

when the voltage of the first input port is higher than the voltage of the second input port, generating a second control signal to electrically isolate the power source and the power voltage setting circuit; and when the voltage of the first input port is lower than the voltage of the second input port, generating the second control signal to electrically connect the power source and the power voltage setting circuit.

14. A power tracking device, comprising:

a power voltage setting circuit comprising an output circuit, wherein the output circuit is configured for outputting an output voltage of a power source, and the output circuit comprises an output switch;

a switch, wherein a first terminal of the switch is connected to a power source, a second terminal of the switch is connected to the output switch of the power voltage setting circuit, and the switch is configured to switch on relative to a first control signal to conduct the power source to the output switch; and a voltage memory circuit for storing an open circuit voltage of the power source and sending a setting voltage relative to the open circuit voltage.

15. The power tracking device of claim 14, wherein the voltage memory circuit comprises:

a capacitor;

an anti-backflow device connected to the power source and the capacitor, the anti-backflow device keeping the open circuit voltage inside the capacitor; and a voltage dividing circuit connected to the capacitor.

16. The power tracking device of claim 15, wherein the voltage dividing circuit comprises:

a first resistor, wherein a terminal of the first resistor is connected to a terminal of the capacitor, and another terminal of the capacitor is connected to ground; and a second resistor, wherein a terminal of the second resistor is connected in series to another terminal of the first resistor, and another terminal of the second resistor is connected to ground.

17. The power tracking device of claim 16, wherein the power source is a solar panel, and one of the first and the second resistor is a photoresistor.

18. The power tracking device of claim 16, wherein one of the first and the second resistor is a digital resistor.

19. The power tracking device of claim 15, wherein the power source is a solar panel.

20. The power tracking device of claim 14, wherein the power voltage setting circuit further comprises:

a comparator comprising a first input port, a second input port, and an output port, wherein the first input port receives the setting voltage, and the second input port is connected to the second terminal of the switch.

* * * * *